US006768262B2

(12) United States Patent
Ahn et al.

(10) Patent No.: US 6,768,262 B2
(45) Date of Patent: Jul. 27, 2004

(54) PLASMA DISPLAY PANEL

(75) Inventors: Young Joon Ahn, Gumi-si (KR); Seong Ho Kang, Daegu-si (KR)

(73) Assignee: LG Electronics Inc., Seoul (KR)

( * ) Notice: Subject to any disclaimer, the term of this patent is extended or adjusted under 35 U.S.C. 154(b) by 1 day.

(21) Appl. No.: 10/259,625

(22) Filed: Sep. 30, 2002

(65) Prior Publication Data

US 2003/0062836 A1 Apr. 3, 2003

(30) Foreign Application Priority Data

Sep. 28, 2001 (KR) ..... 2001-60723

(51) Int. Cl.[7] ..... H01J 17/49

(52) U.S. Cl. ..... 313/582; 313/584; 313/586; 313/587

(58) Field of Search ..... 313/582, 584, 313/586, 587, 495

(56) References Cited

U.S. PATENT DOCUMENTS 5,952,782 A * 9/1999 Nanto et al. ..... 313/587
5,998,935 A * 12/1999 Marcotte ..... 313/582
6,137,226 A * 10/2000 Nagano ..... 313/586
6,333,597 B1 * 12/2001 Mitomo ..... 313/587

* cited by examiner

*Primary Examiner*—Nimeshkumar D. Patel
*Assistant Examiner*—Mariceli Santiago
(74) *Attorney, Agent, or Firm*—Fleshner & Kim, LLP

(57) ABSTRACT

The present invention relates to a plasma display panel for maintaining the light emission and enhancing the contrast. The plasma display panel of the present invention includes the first electrodes for receiving scan pulses, the second electrodes for receiving first sustain pulses and the third electrodes for receiving second sustain pulses. The black matrices are formed to cover the first electrodes. Thus, the first electrodes are used during resetting or addressing and the second electrodes and the third electrodes are use during sustaining so as to maintain the light emission and enhance the contrast greatly.

25 Claims, 4 Drawing Sheets

PLASMA DISPLAY PANEL

BACKGROUND OF THE INVENTION

1. Field of the Invention

The present invention relates to a plasma display panel, and more particularly, to a plasma display panel capable of improving the contrast using a black matrix.

2. Description of the Related Art

In general, a plasma display panel (hereafter, referred to as PDP) is a display device that uses the visible rays generated when vacuum ultraviolet rays generated by gas discharge excite phosphor.

The PDP is thinner in thickness and lighter in weight than the cathode ray tubes (CRTs) that have been usually employed as display devices. The PDP has an advantage in that a high definition and large-sized screen can be realized.

The PDP that has such advantages described above includes many discharge cells arranged in matrix fashion and each of the discharge cells works as one pixel of a screen.

FIG. 1 illustrates the structure of three-electrode AC surface discharge type PDP in the related art. Even though FIG. 1 depicts one discharge cell 1 for the convenience of explanation, a PDP has generally many millions of the discharge cells 1 shown in the FIG. 1 in matrix fashion.

Referring to FIG. 1, a three-electrode AC surface discharge type PDP in the related art includes first electrodes 12Y and second electrodes 12Z formed on a front substrate 10 and address electrodes 20X formed on a rear substrate 18.

A front dielectric layer 14 and a protective layer 16 are laminated on the front substrate 10 that has the first electrodes 12Y and the second electrodes 12Z arranged in parallel. Wall charge generated during plasma discharge is stored on the front dielectric layer 14. The front dielectric layer 14 is designed to have a thickness within 30 $\mu$m to 45 $\mu$m. The protective layer 16 protects the front dielectric layer 14 from damages caused by sputtering during plasma discharge and also improves the second electrons emission efficiency. The protective layer 16 is usually made of magnesium oxide (MgO).

A rear dielectric layer 22 and barrier ribs 24 are formed on the rear substrate 18 that has the address electrodes 20X formed thereon. A phosphor layer 26 is coated on the surfaces of the rear dielectric layer 22 and the barrier ribs 24. The address electrodes 20X is formed in the direction to cross over the first electrodes 12Y and the second electrodes 12Z. The barrier ribs 24 are formed in parallel with the address electrodes 20X so as to prevent the ultraviolet rays and the visible rays generated by the plasma discharge from leaking into the neighboring discharge cells 1.

The phosphor layer 26 is excited by the ultraviolet rays generated during the plasma discharge so as to generate one of visible rays of red, green and blue colors. The inert gas for discharge is injected into discharge spaces prepared between the front substrate 10/the rear substrate 18 and the barrier ribs 24. As shown in FIG. 2, a black matrix is formed between the first electrode 12Y and the second electrode 12Z which are respectively formed in the neighboring discharge cells 1. FIG. 2 illustrates the front substrate 10 of PDP shown in FIG. 1. As shown in FIG. 2, a black matrix 30 is formed between a first electrodes group including the electrodes 12Y1 and the second electrodes 12Z1 and a second electrodes group including the electrodes 12Y2 and the second electrodes 12Z2 that are different from electrodes 12Y1 and the second electrodes 12Z1 respectively. More particularly, the black matrix 30 is formed on the areas from the external edge 11 of the second electrodes 12Z1 included in the first electrodes group to the external edge 13 of the first electrodes 12Y2 included in the second electrodes group.

In this AC surface discharge type PDP, one frame is divided into a few subfields each of which is different from others in the number of discharge times so as to display the gray levels of images. Each of the subfields is divided into a reset period for generating a uniform discharge, an address period for selecting a discharge cell, and a sustain period for displaying gray levels according to the number of discharge times. For example, to display an image in 256 gray levels, the frame period (16.67 ms) corresponding to one 60th second is divided into eight subfields.

Each of the eight subfields is divided into the reset period, the address period and a sustain period. The reset period of each subfield is the same as the address period in length while the sustain period increases at each subfield at the ratio of $2^n$ (n=0, 1, 2, 3, 4, 5, 6 and 7). In this way, the sustain period of each field is different from that of other fields, and hence the gray levels of the image can be displayed.

In the reset period, reset pulses are applied to the first electrodes 12Y to cause reset discharge. In the address period, scan pulses are applied to the first electrodes 12Y and data pulses are applied to the address electrodes 20X to cause address discharge between two electrodes 12Y and 20X. The wall charge is created on the front dielectric layer 14 and the rear dielectric layer 22 during the address discharge. In the sustain period, AC signals that are alternatively applied to the first electrodes 12Y and the second electrodes 12Z cause sustain discharge between two electrodes 12Y and 12Z.

In such a PDP of the related art, the contrast is degenerated due to the reset discharge caused in the reset period and the address discharge caused in the address discharge. In other words, the light generated by the reset discharge and the address discharge lowers darkroom contrast since the reset discharge and the address discharge do not contribute to the brightness of the PDP.

In order to improve the contrast, as shown in FIG. 3, a black matrix 32 is formed on the areas from the external edge 15 of the second electrodes 12Z1 included in the first electrodes group to the external edge 17 of the first electrodes 12Y2 included in the second electrodes group. The black matrix 32 shields the light generated by the reset discharge and the address discharge to improve the contrast. Since the light generated by the first electrodes 12Y2 during the reset discharge and the address discharge does not contribute to the brightness, the black matrix 32 shields the light to improve the contrast.

However, the black matrix 32 to improve the contrast also shields the light generated by the sustain discharge that contributes to the brightness. The sustain pulses are applied to the first electrodes 12Y2. It is desired that the light generated by the sustain discharge should not be shielded since it contributes to the brightness. In case a black matrix 32 is formed on the areas from the external edge 15 of the second electrodes 12Z1 included in the first electrodes group to the external edge 17 of the first electrodes 12Y2 included in the second electrodes group, the black matrix 32 also shields the light generated by the sustain discharge so that the brightness degenerates and also the light emission efficiency and the display quality deteriorate.

SUMMARY OF THE INVENTION

An object of the invention is to at least the above problems and/or disadvantages and to provide at least the advantages described hereinafter.

Accordingly, it is an object of the present invention to provide a plasma display panel capable of enhancing the contrast by overlapping a first electrode to which scan pulses are applied among a plurality of electrodes with a black matrix.

These and other objects and advantages of the invention are achieved by providing a plasma display panel which includes: a first electrodes group including a first electrode formed on a front substrate, a second electrode formed in parallel with and near to the first electrode, and a third electrode formed in parallel with and spaced widely from the second electrode; a second electrodes group formed adjacent to the first electrodes group, and including first to third electrodes, the first to third electrodes of the second electrodes group playing the same roles as the first to third electrodes of the first electrodes group; and a plurality of black matrices formed between the neighboring first electrodes group and the neighboring second electrodes group to be overlapped with the first electrodes of the first electrodes group and the first electrodes of the second electrodes group.

Preferably, the first to the third electrodes of the second electrodes group are formed in a same order as the first to third electrodes of the first electrodes group, and the black matrices are overlapped between the neighboring first electrodes group and the neighboring second electrodes group.

Preferably, the first electrodes, the second electrodes and the third electrodes of the second electrodes group are arranged symmetrically to the first electrodes, the second electrodes and the third electrodes of the first electrodes group.

Preferably, the plasma display panel further includes: a front dielectric layer formed to cover the first electrodes group, the second electrodes group and the front substrate; and a protective layer formed to cover the front dielectric layer.

Preferably, the black matrices are formed between the front dielectric layer and protective layer.

According to another aspect of the present invention, a plasma display panel includes: a first electrodes group including a first electrode formed on a front substrate, a second electrode formed in parallel with and near to the first electrode, and a third electrode formed in parallel with and spaced widely from the second electrode; a second electrodes group provided with a first electrode, a second electrode and a third electrode formed in a same order as and adjacent to the first to third electrodes of the first electrodes group, the first to third electrodes of the second electrodes group playing same roles as the first to third electrodes of the first electrodes group; a plurality of black matrices formed between the neighboring first electrodes group and the neighboring second electrodes group to be overlapped with areas from external edges of the third electrodes of the first electrodes group to the first electrodes of the second electrodes group; a front dielectric layer formed to cover the first electrodes group, the second electrodes group and the front substrate; and a protective layer formed to cover the front dielectric layer.

According to further another aspect of the present invention, a plasma display panel includes: a first electrodes group including a first electrode formed on a front substrate, a second electrode formed near to the first electrode, and a third electrode formed spaced widely from the second electrode; a second electrodes group including first to third electrodes, the first to third electrodes of the second electrodes group being formed symmetrically to the first to third electrodes of the first electrodes group with respect to left and right directions and playing the same roles as the first to third electrodes of the first electrodes group; a plurality of black matrices formed between the neighboring first electrodes group and the neighboring second electrodes group to be overlapped with the first electrodes of the first electrodes group and the first electrodes of the second electrodes group; a front dielectric layer formed to cover the first electrodes group, the second electrodes group and the front substrate; and a protective layer formed to cover the front dielectric layer.

According to still another aspect of the present invention, a plasma display panel includes: a first dielectric layer formed on a front substrate; a first electrodes group including a first electrode formed on the first dielectric layer, a second electrode formed in parallel with and near to the first electrode, and a third electrode formed in parallel with and spaced widely from the second electrode; a second electrodes group including first to third electrodes formed adjacent to the first to third electrodes of the first electrodes group, the first to third electrodes of the second electrodes group playing the same roles as the first to third electrodes of the first electrodes group; a second dielectric layer formed to cover the first electrodes group and the second electrodes group; a protective layer formed to cover the second dielectric layer; and a plurality of black matrices formed between the front substrate and the first dielectric layer and between the neighboring first electrodes group and the neighboring second electrodes group to be overlapped with the first electrodes of the first electrodes group and the first electrodes of the second electrodes group.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The following detailed description will present a preferred embodiment of the invention in reference to the accompanying drawings.

DETAILED DESCRIPTION OF THE PREFERRED EMBODIMENTS

Reference will now be made in detail to a preferred embodiment of the present invention.

Figure 1:
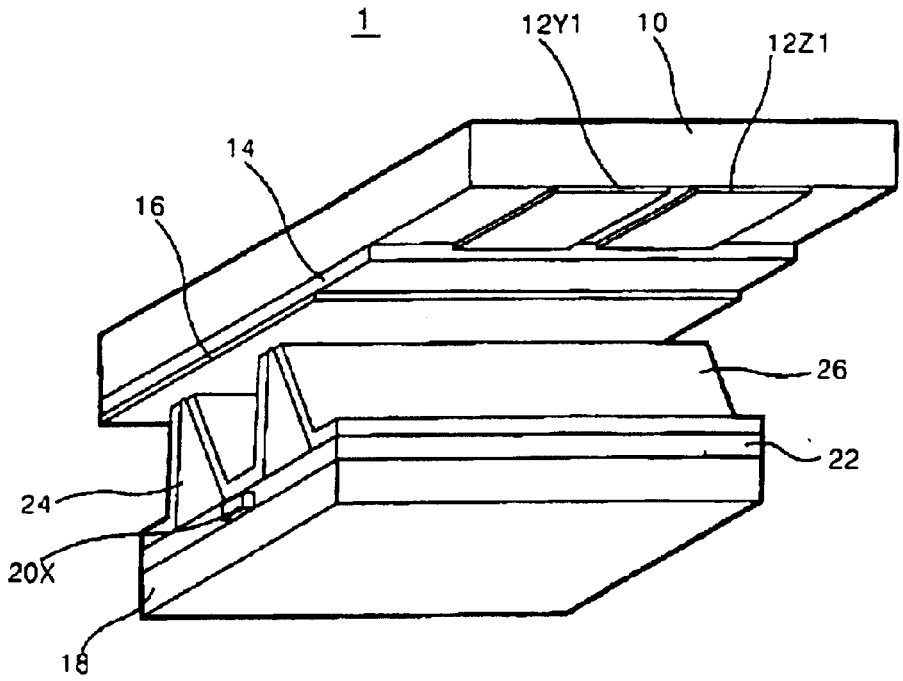
Fig. 1(Related Art)
FIG. 1 is an exploded perspective view of the three-electrode AC surface discharge type PDP of the prior art.
Figure 2:
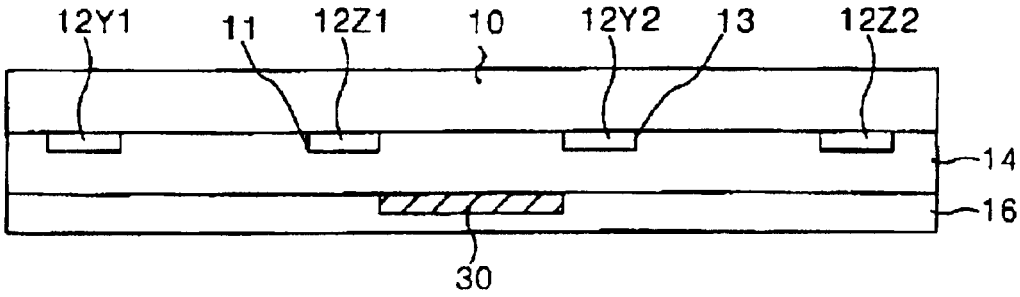
Fig. 2(Related Art)
FIG. 2 is a cross sectional view of an embodiment of a front substrate having black matrices in the three-electrode AC surface discharge type PDP shown in FIG. 1.
Figure 3:
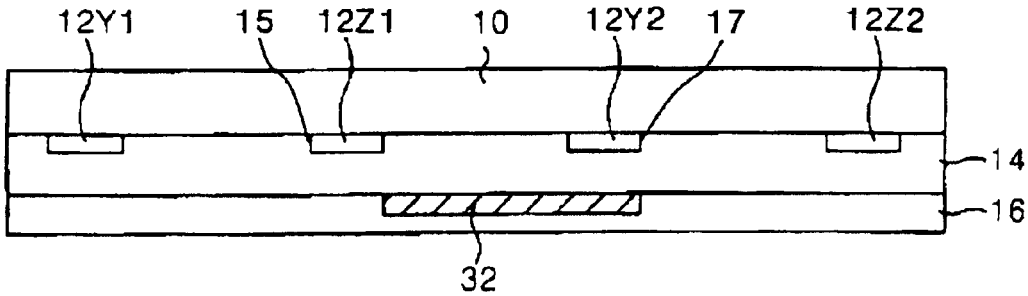
Fig. 3(Related Art)
FIG. 3 is a cross sectional view of another embodiment of a front substrate having black matrices in the three-electrode AC surface discharge type PDP shown in FIG. 1.
Figure 4:
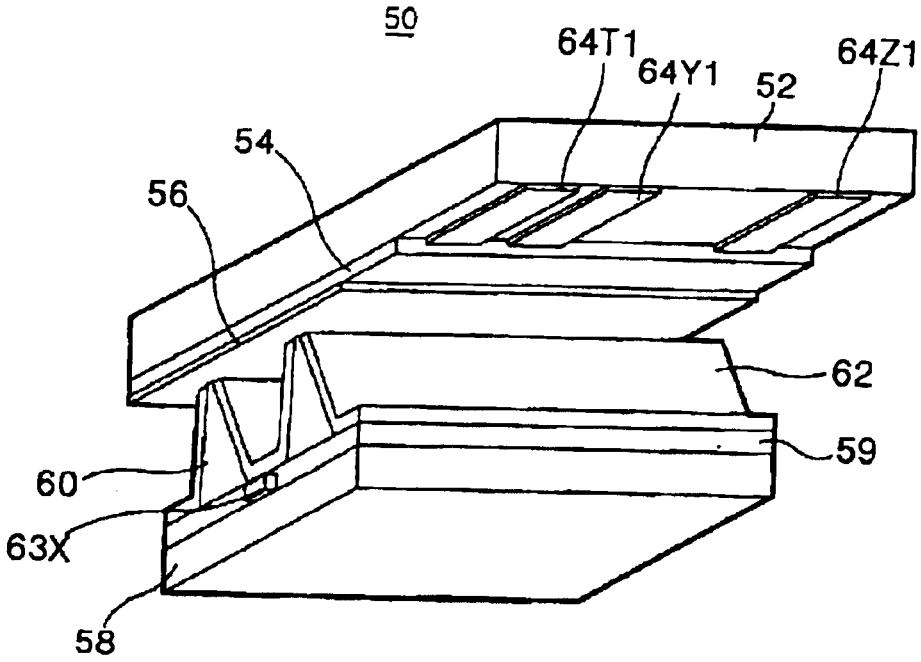
FIG. 4 is an exploded perspective view of the PDP according to the preferred embodiment of the present invention.

FIG. 4 is an exploded perspective view of the PDP according to the preferred embodiment of the present invention, and more particularly, of one discharge cell 50 of PDP. Referring to FIG. 4, a discharge cell 50 of a PDP according to the first embodiment of the present invention includes first electrode 64T1, second electrode 64Y1 and third electrode 64Z1 formed in parallel on a front substrate 52. It is desired that the first electrode 64T1, the second electrode 64Y1 and the third electrode 64Z1 be used as a scan electrode, a first sustain electrode and a second sustain electrode respectively.

In general, first electrodes and second electrodes are formed on a front substrate in the prior art. The first electrodes are used as both scan electrodes and first sustain electrodes and the second electrodes are used as second sustain electrodes. In contrast, in a discharge cell 50 of a PDP according to the first embodiment of the present invention, a first electrode 64T1 and a second electrode 64Y1 are formed on a front substrate 52 so as to separate a scan electrode and a first sustain electrodes.

It is desired that a second electrode 64Y1 be formed near to the first electrode 64T1 while a third electrode 64Z1 be formed spaced widely from the second electrode 64Y1. A front dielectric layer 54 and a protective layer 56 are laminated successively on the first electrode 64T1, the second electrode 64Y1, the third electrode 64Z1 and the front substrate 52. The wall charge is generated during plasma discharge is stored on the front dielectric layer 54. The protective layer 56 protects the front dielectric layer 54 from damages caused by sputtering during plasma discharge and also improves the second electrons emission efficiency.

An address electrode 63X is formed on a rear substrate 58 and orthogonal to the first electrode 64T1, the second electrode 64Y1 and the third electrode 64Z1. A rear dielectric layer 59 is formed on the address electrode 63X and the rear substrate 58. The barrier ribs 60 are formed in parallel with the address electrode 63X. A phosphor layer 62 is coated on the surfaces of the barrier ribs 60 and the rear dielectric layer 59. The barrier ribs 60 prevent the ultraviolet rays and the visible rays generated by the plasma discharge from leaking into the neighboring discharge cells. The phosphor layer 62 is excited by the ultraviolet rays generated during the plasma discharge so as to generate one of visible rays among red, green and blue colors. The inert gas for discharge is injected into discharge spaces prepared between the front substrate 52/the rear substrate 58 and the barrier ribs 60. Here, a black matrix is formed between the neighboring discharge cells. This is depicted in FIG. 5.

In general, PDP is composed of many discharge cells 50 shown in FIG. 4 arranged in matrix fashion. FIG. 5 illustrates a front substrate for convenience of explanation. It depicts a first electrodes group 68 including the first electrode 64T1, the second electrode 64Y1 and the third electrode 64Z1, and a second electrodes group 70 including the first electrode 64T2, the second electrode 64Y2 and the third electrode 64Z2 which are different from the first electrode 64T1, the second electrode 64Y1 and the third electrode 64Z1 respectively. In other words, the first electrode 64T2, the second electrode 64Y2 and the third electrode 64Z2 included in second electrodes group 70 are arranged in the same order of the first electrode 64T1, the second electrode 64Y1 and the third electrode 64Z1 included in the first electrodes group 68. The second electrodes group 70 has the first electrode 64T2, the second electrode 64Y2 and the third electrode 64Z2 in the order in which the first electrodes group 68 has the first electrode 64T1, the second electrode 64Y1 and the third electrode 64Z1.

Figure 5:
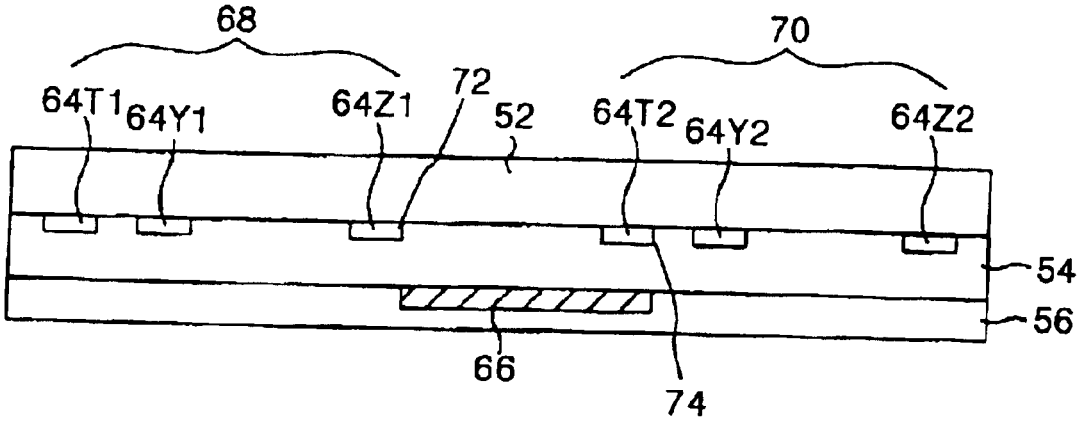
FIGS. 5 and 6 illustrate the first embodiment of a front substrate having black matrices in the PDP shown in FIG. 4.

As shown in FIG. 5, the black matrix 66 is formed between the first electrodes group 68 and the second electrodes group 70. The black matrix 66 is formed between the front dielectric layer 54 and protective layer 56. More particularly, it is desired that the black matrix 66 be overlapped with the area from external edge 72 of the third electrode 64Z1 of the first electrodes group 68 to the first electrode 64T2 of the second electrodes group 70. In this case, the black matrix 66 may be overlapped with a portion of the first electrode 64T2 of the second electrodes group 70 or may be overlapped with an inner edge 74 of the first electrode 64T2 of the second electrodes group 70. Such a black matrix 66 is made of dielectric material.

In reset period, reset pulses are applied to the first electrodes 64T2 of the second electrodes group 70 so as to cause reset discharge. The light generated by the reset discharge is absorbed by the black matrix 66 that is overlapped with the first electrodes 64T2 of the second electrodes group 70.

In address period, scan pulses are applied to the first electrodes 64T2 of the second electrodes group 70 and data pulses are applied to the address electrodes 63X so as to cause address discharge. The light generated by the address discharge is also absorbed by the black matrix 66. This results in contrast improvement.

In sustain period, sustain pulses are alternatively applied to the second electrode 64Y2 and the third electrode 64Z2 of the second electrodes group 70 so as to cause sustain discharge. Accordingly, since the black matrix 66 is formed to cover only the first electrodes 64T2 of the second electrodes group 70, the light generated by the sustain discharge is not absorbed by the black matrix 66. This does not result in the deterioration of the light emission efficiency.

Figure 6:
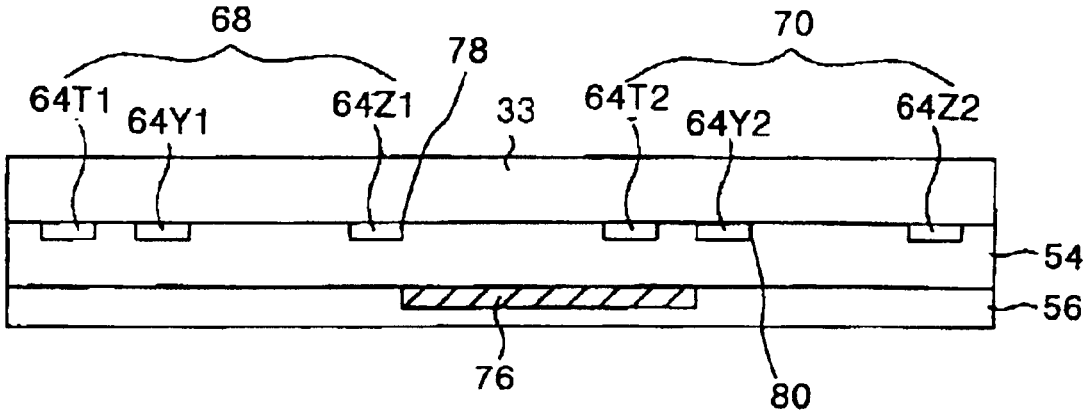

On the other hand, as shown in FIG. 6, a black matrix 76 may be overlapped with the first electrode 64T2 and the external edge of the second electrode 64Y2 of the second electrodes group 70. In other words, the black matrix 76 can be formed to cover the area from an external edge 78 of the third electrode 64Z1 of the first electrodes group 68 to an external edge 80 of the first electrode 64Y2 of the second electrodes group 70.

Figure 7:
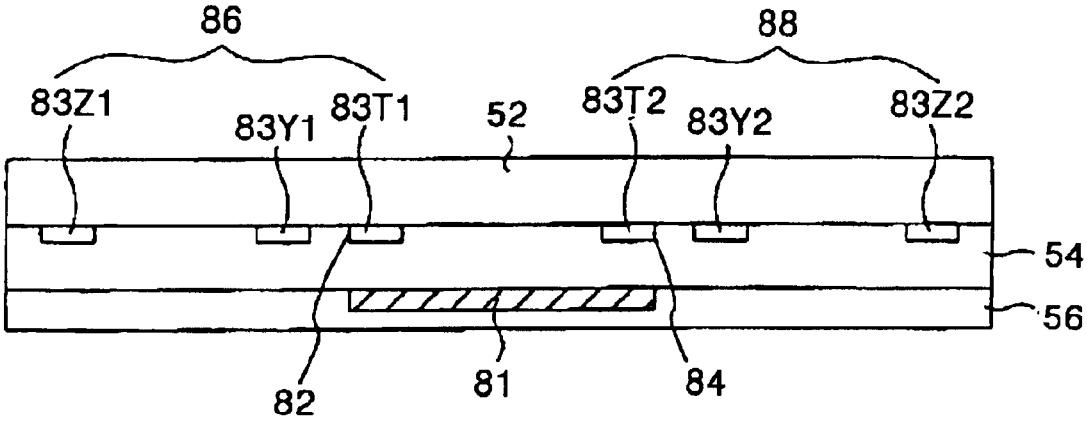
FIGS. 7 and 8 illustrate the second embodiment of a front substrate having black matrices in the PDP shown in FIG. 4.

FIG. 7 illustrates the second embodiment of a front substrate having black matrices in the PDP shown in FIG. 4. As shown in FIG. 7, a first electrode 83T2, a second electrode 83Y2 and a third electrode 83Z2 of a second electrodes group 88 are arranged symmetrically to a first electrode 83T1, a second electrode 83Y1 and a third electrode 83Z1 of a first electrodes group 86. In other words, the first electrodes group 86 and the second electrodes group 88 is formed in the mirror symmetric form to interpose the black matrix 81 between themselves. In this electrodes arrangement, the black matrix 81 is formed to cover the area from inner edge 82 of the first electrode 83T1 of the first electrodes group 86 to inner edge 84 of the first electrode 83T1 of the second electrodes group 88 as shown in FIG. 7.

As another case, even though not described in drawings, the black matrix is formed to cover the area from the portion between the neighboring first electrode 83T1 and the neighboring second electrode 83Y1 of the first electrodes group 86 to the portion between the neighboring first electrode 83T2 and the neighboring second electrode 83Y2 of the second electrodes group 88.

Figure 8:
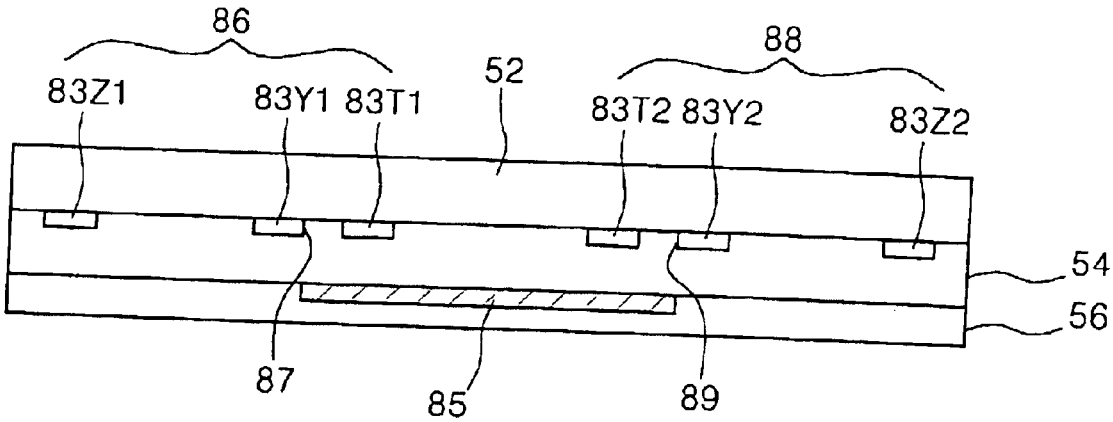

As shown in FIG. 8, the black matrix 85 is formed to cover the area from an external edge 87 of the second electrode 83Y1 of the first electrodes group 86 to an external edge 89 of the second electrode 83Y2 of the second electrodes group 88.

As shown in FIGS. 7 and 8, if the black matrices 81 and 85 are formed to cover the areas between inner edges 82 and 84 of the first electrodes 83T1 and 83T2 of the first and second electrodes group 86 and 88 or the areas between external edges 87 and 89 of the second electrodes 83Y1 and 83Y2 of the first and second electrodes group 86 and 88, the light generated during the reset period or the address period is absorbed by the black matrices 81 and 85 while the light generated during the sustain period is not absorbed by the black matrices 81 and 85. This makes the light emission efficiency not degenerate and the contrast be improved.

On the other hand, the black matrices 66, 76, 81 and 85 illustrated by FIGS. 5 through 8 can be formed between the front 52 and the electrodes group 68, 70, 86 and 88. These are described referring to FIG. 9.

Figure 9:
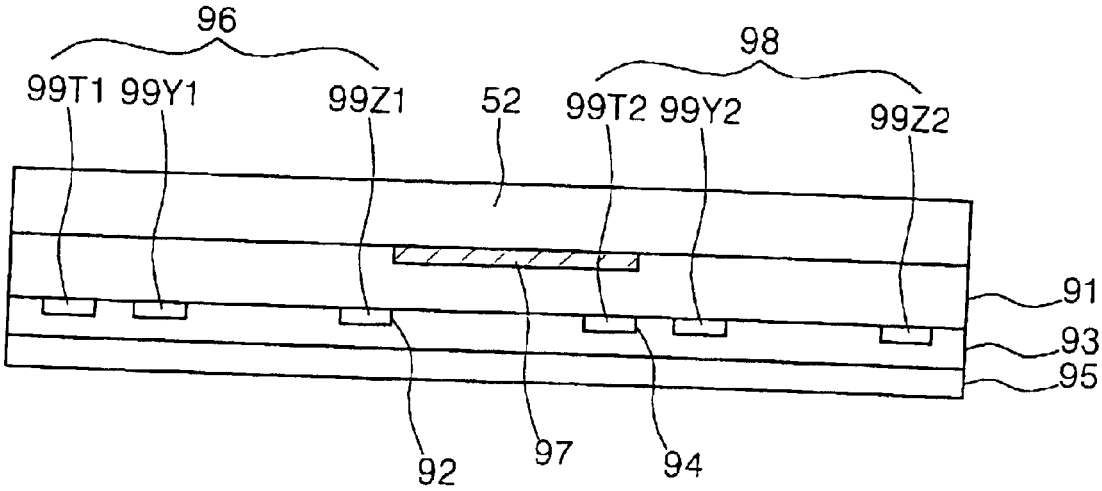
FIG. 9 illustrates the third embodiment of a front substrate having black matrices in a PDP.

FIG. 9 illustrates the third embodiment of a front substrate having black matrices in a PDP. Referring to FIG. 9, a first dielectric layer 91 is formed on a front substrate 52 and black matrix 97 is provided between the front substrate 52 and the first dielectric sub-layer. First electrodes group 96 and second electrodes group 98 are formed near to each other neighboring in parallel on the first dielectric layer 91. The first electrodes group 96 include a first electrode 99T1, a second electrode 99Y1 near to the first electrode 99T1, and a third electrode 99Z1 spaced widely from the second electrode 99Y1. Also the second electrodes group 98 includes a first electrode 99T2, a second electrode 99Y2 near to the first electrode 99T2, and a third electrode 99Z2 spaced widely from the second electrode 99Y2. The first electrode 99T2, the second electrode 99Y2 and the third electrode 99Z2 of the second electrodes group 98 work as the same as the first electrode 99T1, the second electrode 99Y1 and the third electrode 99Z1 of the first electrodes group 96. The first electrode 99T1, the second electrode 99Y1 and the third electrode 99Z1 of the first electrodes group 96 are arranged in the same order of the first electrode 99T2, the second electrode 99Y2 and the third electrode 99Z2 of the second electrodes group 98 as shown in FIG. 9. The first electrode 99T1, the second electrode 99Y1 and the third electrode 99Z1 of the first electrodes group 96 may be arranged in the symmetric (opposite) order of the first electrode 99T2, the second electrode 99Y2 and the third electrode 99Z2 of the second electrodes group 98 as shown in FIGS. 7 and 8.

A second dielectric layer 93 is formed to cover a first layer 91, the first electrodes group 96 and the second electrodes group 98. A protective layer 95 is formed to cover the second dielectric layer 93.

As shown in FIG. 9, the black matrix 97 is formed to cover the area from external edge 92 of the third electrode 99Z1 of the first electrodes group 96 to inner edge 94 of the first electrode 99T2 of the second electrodes group 98. The black matrix 97 is formed to cover the portion or the entire area of the first electrodes 99T1 of the first electrodes group 96. As the same manner, even though the black matrix 97 is formed on the back surface of the front substrate 52, the same effects as the other embodiments can be obtained.

The present invention is characterized in that the light generated during the reset period or the address period is prevented from releasing to the externals by covering black matrices over first electrodes. Therefore, note that it is very critical not how much the black matrices are overlapped with the first electrodes but whether the black matrices are overlapped with the first electrodes so as to shield the light required for light emission.

As above described, the plasma display panel according to the present invention in which black matrices are formed to cover the first electrodes for receiving reset pulses and scan pulses improve the contrast. At the same time, it does not lower the light emission efficiency since sustain pulses are applied to second electrodes and third electrodes.

The forgoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A plasma display panel, comprising:

a first electrodes group including a first electrode formed on a front substrate, a second electrode formed in parallel with and near to the first electrode, and a third electrode formed in parallel with and spaced widely from the second electrode;

a second electrodes group formed adjacent to the first electrodes group, and including first to third electrodes, the first to third electrodes of the second electrodes group playing the same roles as the first to third electrodes of the first electrodes group; and a plurality of black matrices formed between the neighboring first electrodes group and the neighboring second electrodes group to be overlapped with the first electrode of the first electrodes group and the first electrode of the second electrodes group.

2. The plasma display panel according to claim 1, wherein the first to the third electrodes of the second electrodes group are formed in a same order as the first to third electrodes of the first electrodes group, and the black matrices are overlapped between the neighboring first electrodes group and the neighboring second electrodes group.

3. The plasma display panel according to claim 2, wherein the black matrices are overlapped with areas from external edges of the third electrodes of the first electrodes group to the first electrode of the second electrode groups.

4. The plasma display panel according to claim 3, wherein the black matrices are partially overlapped with the first electrode of the second electrodes group.

5. The plasma display panel according to claim 3, wherein the black matrices are overlapped with inner edges of the first electrode of the second electrodes group.

6. The plasma display panel according to claim 2, wherein the black matrices are overlapped with areas from external edges of the third electrode of the first electrodes group to external edges of the first electrode of the second electrodes group.

7. The plasma display panel according to claim 1, wherein the first electrode, the second electrode and the third electrode of the second electrodes group are arranged symmetrically to the first electrode, the second electrode and the third electrode of the first electrodes group.

8. The plasma display panel according to claim 7, wherein the black matrices are overlapped with areas from inner edges of the second electrode of the first electrodes group to inner edges of the first electrode of the second electrodes group.

9. The plasma display panel according to claim 7, wherein the black matrices are overlapped with areas from external edges of the second electrode of the first electrodes group to external edges of the second electrode of the second electrodes group.

10. The plasma display panel according to claim 7, wherein the black matrices are overlapped with areas from portions between a neighboring first electrode and a neighboring second electrode of the first electrodes group to portions between a neighboring first electrode and a neighboring second electrode of the second electrodes group.

11. The plasma display panel according to claim 1, further comprising:

a front dielectric layer formed to cover the first electrodes group, the second electrodes group and the front substrate; and a protective layer formed to cover the front dielectric layer.

12. The plasma display panel according to claim 11, wherein the black matrices are formed between the front dielectric layer and protective layer.

13. The plasma display panel according to claim 1, further comprising:

a first dielectric layer formed to cover the black matrices;

a second dielectric layer formed to cover the first dielectric layer; and a protective layer formed to cover the second dielectric layer.

14. The plasma display panel according to claim 13, wherein the first electrodes group and the second electrodes group are formed between the first dielectric layer and the second dielectric layer.

15. A plasma display panel, comprising:

a first electrodes group including a first electrode formed on a front substrate, a second electrode formed in parallel with and near to the first electrode, and a third electrode formed in parallel with and spaced widely from the second electrode;

a second electrodes group provided with a first electrode, a second electrode and a third electrode formed in a same order as and adjacent to the first to third electrodes of the first electrodes group, the first to third electrodes of the second electrodes group playing same roles as the first to third electrodes of the first electrodes group;

a plurality of black matrices formed between the neighboring first electrodes group and the neighboring second electrodes group to be overlapped with areas from external edges of the third electrode of the first electrodes group to the first electrode of the second electrodes group;

a front dielectric layer formed to cover the first electrodes group, the second electrodes group and the front substrate; and a protective layer formed to cover the front dielectric layer.

16. The plasma display panel according to claim 15, wherein the black matrices are overlapped with areas from external edges of the third electrode of the first electrodes group to portions between the neighboring first electrode and the neighboring second electrode of the second electrodes group.

17. A plasma display panel, comprising:

a first electrodes group including a first electrode formed on a front substrate, a second electrode formed near to the first electrode, and a third electrode formed spaced widely from the second electrode;

a second electrodes group including first to third electrodes, the first to third electrodes of the second electrodes group being formed symmetrically to the first to third electrodes of the first electrodes group with respect to left and right directions and playing the same roles as the first to third electrodes of the first electrodes group;

a plurality of black matrices formed between the neighboring first electrodes group and the neighboring second electrodes group to be overlapped with the first electrode of the first electrodes group and the first electrode of the second electrodes group;

a front dielectric layer formed to cover the first electrodes group, the second electrodes group and the front substrate; and a protective layer formed to cover the front dielectric layer.

18. The plasma display panel according to claim 17, wherein the black matrices are overlapped with areas from internal edges of the first electrode of the first electrodes group to internal edges of the first electrode of the second electrodes group.

19. The plasma display panel according to claim 17, wherein the black matrices are overlapped with areas from external edges of the second electrode of the first electrodes group to external edges of the second electrode of the second electrodes group.

20. A plasma display panel, comprising:

a first dielectric layer formed on a front substrate;

a first electrodes group including a first electrode formed on the first dielectric layer, a second electrode formed in parallel with and near to the first electrode, and a third electrode formed in parallel with and spaced widely from the second electrode;

a second electrodes group including first to third electrodes formed adjacent to the first to third electrodes of the first electrodes group, the first to third electrodes of the second electrodes group playing the same roles as the first to third electrodes of the first electrodes group;

a second dielectric layer formed to cover the first electrodes group and the second electrodes group;

a protective layer formed to cover the second dielectric layer; and a plurality of black matrices formed between the front substrate and the first dielectric layer and between the neighboring first electrodes group and the neighboring second electrodes group to be overlapped with the first electrode of the first electrodes group and the first electrode of the second electrodes group.

21. The plasma display panel according to claim 20, wherein the first electrode, the second electrode and the third electrode of the second electrodes group are arranged in the same order of the first electrode, the second electrode and the third electrode of the first electrodes group.

22. The plasma display panel according to claim 21, wherein the black matrices are overlapped with areas from external edges of the third electrode of the first electrodes group to the first electrode of the second electrodes group.

23. The plasma display panel according to claim 20, wherein the first electrode, the second electrode and the third electrode of the second electrodes group are arranged symmetrically to the first electrode, the second electrode and the third electrode of the first electrodes group.

24. The plasma display panel according to claim 23, wherein the black matrices are overlapped with areas from inner edges of the first electrode of the first electrodes group to inner edges of the first electrode of the second electrodes group.

25. The plasma display panel according to claim 23, wherein the black matrices are overlapped with areas from external edges of the second electrode of the first electrodes group to external edges of the second electrode of the second electrodes group.

* * * * *